US008276532B2

(12) United States Patent
Kawaguchi

(10) Patent No.: US 8,276,532 B2
(45) Date of Patent: Oct. 2, 2012

(54) SEWING MACHINE WITH ENGRAVING FUNCTION

(75) Inventor: Yasuhiko Kawaguchi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 242 days.

(21) Appl. No.: 12/801,283

(22) Filed: Jun. 1, 2010

(65) Prior Publication Data

US 2010/0319597 A1 Dec. 23, 2010

(30) Foreign Application Priority Data

Jun. 23, 2009 (JP) ..... 2009-148613

(51) Int. Cl.
*D05B 19/00* (2006.01)

(52) U.S. Cl. ..... 112/470.05

(58) Field of Classification Search ..... 72/446, 72/455, 379.2; 112/73, 78, 221, 222, 470.05, 112/155, 475.18
See application file for complete search history.

(56) References Cited

U.S. PATENT DOCUMENTS 4,527,498 A 7/1985 Tazawa
5,810,526 A * 9/1998 Hirai ..... 409/131
5,915,316 A * 6/1999 Tajima et al. ..... 112/470.05
7,467,535 B2 12/2008 Kuno et al.
2007/0000299 A1 1/2007 Kuno et al.

FOREIGN PATENT DOCUMENTS

| | | |
|---|---|---|
| JP | A-55-90667 | 7/1980 |
| JP | U-59-145374 | 9/1984 |
| JP | U-6-81467 | 11/1994 |
| JP | A-11-172566 | 6/1999 |
| JP | A-2007-8133 | 1/2007 |

* cited by examiner

*Primary Examiner* — Tejash Patel
(74) *Attorney, Agent, or Firm* — Oliff & Berridge, PLC

(57) ABSTRACT

A sewing machine includes a holder including an embroidery frame holding a workpiece cloth and a striking holder holding an engraving workpiece which is to be engraved by striking, a transfer mechanism detachably attached to either the embroidery frame or the striking holder to transfer the embroidery frame or the striking holder on a sewing machine bed, a striking needle which is struck against the engraving workpiece to engrave the engraving workpiece, a drive mechanism reciprocally driving the striking needle upward and downward, and a control device controlling at least one of execution of an embroidery sewing operation onto the workpiece cloth and execution of an engraving operation in which the striking needle is moved upward and downward so that the striking needle is struck against the engraving workpiece held by the striking holder while the striking holder is moved by the transfer mechanism.

11 Claims, 8 Drawing Sheets

SEWING MACHINE WITH ENGRAVING FUNCTION

CROSS-REFERENCE TO RELATED APPLICATIONS

This application is based upon and claims the benefit of priority from the prior Japanese Patent Application No. 2009-148613 filed on Jun. 23, 2009, the entire contents of which are incorporated herein by reference.

BACKGROUND

1. Technical Field

The present disclosure relates to a sewing machine including a holder which holds a workpiece cloth to be sewn and a transfer mechanism to which the holder is detachably attachable and which transfers the holder holding the workpiece cloth on a sewing machine bed freely in a predetermined direction, the sewing machine being capable of executing an embroidery sewing operation.

2. Related Art

There has conventionally been provided a multineedle embroidery sewing machine which can continuously execute embroidery sewing with the use of multicolor embroidery threads, for example. The multineedle embroidery sewing machine is provided with a needle bar case which is mounted on a distal end of an arm and has, for example, six needle bars. A predetermined one of the needle bars is selectively coupled to a needle bar driving mechanism thereby to be vertically driven. A control device of the sewing machine controls a multicolor embroidery sewing operation, based on pattern data which orders a needle position per stitch, that is, an amount of movement of workpiece cloth, color change and the like. In the embroidery sewing operation, the needle bar driving mechanism and other driving mechanisms are controlled while an embroidery frame holding the workpiece cloth is moved in the X and Y directions by the transfer mechanism.

The above-described multineedle embroidery sewing machine includes a type that can embellish workpiece cloth by a needle punch or punch needle embroidery technique. In this type of sewing machine, punch needles are attached to some of the needle bars instead of sewing needles so that a needle punch is applied to the workpiece cloth based on needle punch information.

An apparatus has recently been provided which engraves desired photograph, illustration, characters and the like on the surfaces of a plastic or metallic plate and a board made of wood or fabric using striking needles, thereby producing accessories and furnishing goods. An apparatus automatically executing the engraving includes an engraving apparatus to which a dot impact printer is applied. In this engraving apparatus, a workpiece is moved in the Y direction while a printer head provided with a plurality of striking needles is moved in the X direction, whereby a predetermined engraving is applied to the surface of the workpiece.

The inventors conceived use of the aforementioned multineedle embroidery sewing machine as an apparatus for performing the above-described engraving by attaching one or more striking needles to embroidery sewing needles, instead of the embroidery sewing needles. In this case, a holder which fixedly holds a workpiece is mounted to a carriage of the transfer mechanism, instead of an embroidery frame holding the workpiece cloth. A needle bar to which the a striking needle is attached is moved up and down while the workpiece is moved by the transfer mechanism based on engraving data, whereby a predetermined pattern or the like is considered to be engraved on the surface of workpiece cloth.

However, when a striking needle is attached to the needle bar and an engraving operation is executed by moving the needle bar upward and downward as described above, there is a possibility that the user may erroneously bring something into contact with the stamping needle in operation thereby to interrupt the stamping operation.

Furthermore, one turn of a main shaft moves the stamping needle upward and downward once. Accordingly, the number of striking operations has a one-to-one relation with the number of revolutions of the main shaft. The following problem occurs when a striking speed or working efficiency is to be increased. When the main shaft is rotated at 500 rpm, for example, the striking operation is carried out at 500 times per minute. In this case, the rotational speed of the main shaft needs to be doubled into 1000 rpm in order that the striking speed may be doubled, whereupon a time period of high speed rotation of the sewing machine is prolonged. This reduces endurance times or service lives of the needle bar driving mechanism and components such as the sewing machine motor driving the needle bar driving mechanism.

SUMMARY

Therefore, an object of the disclosure is to provide a sewing machine which can smoothly perform the striking operation onto the surface of the workpiece to be engraved in addition to the normal embroidery sewing operation for the workpiece cloth and which can improve the efficiency of the striking operation without an excessive increase in the rotational speeds of the main shaft and the sewing machine motor.

The present disclosure provides a sewing machine comprising a sewing machine bed; a holder configured to hold either one of an embroidery frame that is configured to hold a workpiece cloth or a striking holder that is configured to hold an engraving workpiece that is configured to be engraved by striking; a transfer mechanism which is detachably attached to the embroidery frame or the striking holder to transfer the embroidery frame or the striking holder freely in a predetermined direction on the sewing machine bed; a striking needle that is configured to strike against the engraving workpiece to thereby engrave the engraving workpiece when the holder holds the striking holder; a drive mechanism which reciprocally drives the striking needle upward and downward, from below, toward a region where the engraving workpiece is held by the striking holder, and a control device which controls execution of an embroidery sewing operation onto the workpiece cloth or execution of an engraving operation in which the striking needle is moved upward and downward by the drive mechanism so that the striking needle is struck against the engraving workpiece held by the striking holder, from below, while the striking holder is moved by the transfer mechanism.

DETAILED DESCRIPTION

Figure 1:
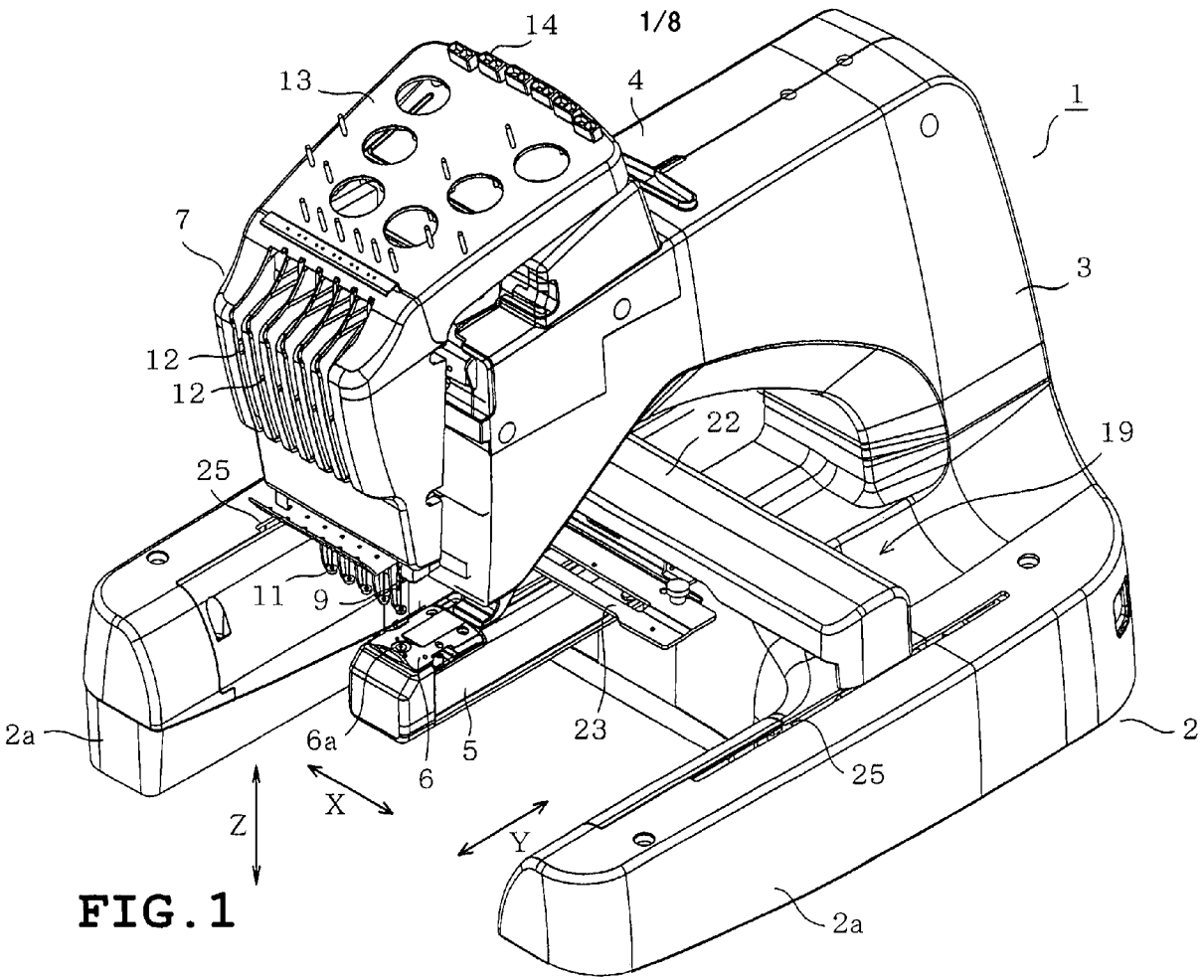
FIG. 1 is a perspective view of a sewing machine body of a first illustrative example.
Figure 5:
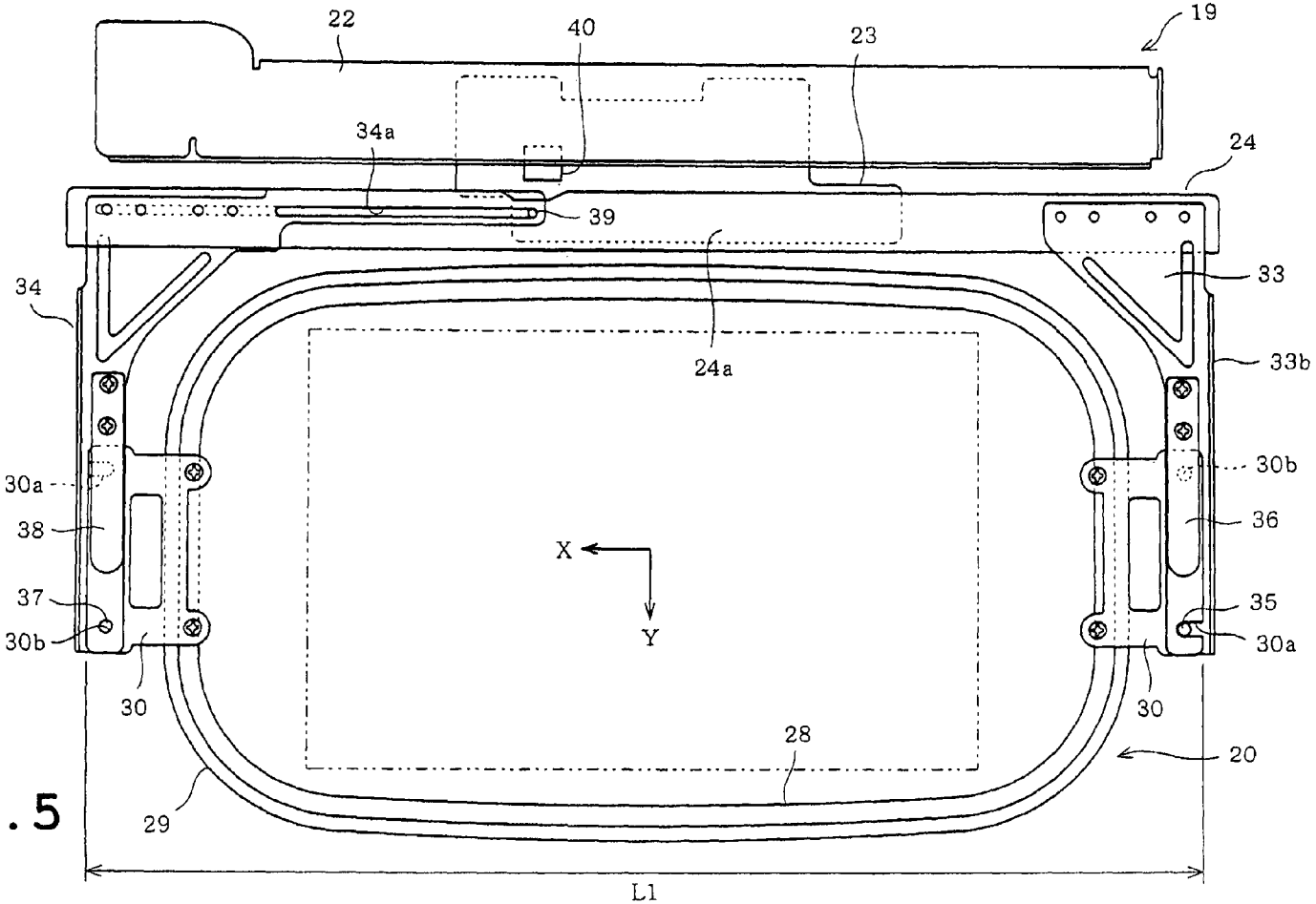
FIG. 5 is a plan view of the frame holder to which an embroidery frame is attached.

An embodiment will be described with reference to the accompanying drawings. Referring to FIG. 1, an overall construction of the body 1 of a multineedle embroidery sewing machine is shown. In the following description, the right-left direction of a sewing machine body 1 will be referred to as "X direction" and the front-back direction thereof will be referred to as "Y direction" as shown in FIGS. 1, 5 and so on. Furthermore, the vertical direction of the sewing machine body 1 will be referred to as "Z direction."

The sewing machine body 1 includes a support base 2 placed on a mounting base which is not shown, a pillar 3 extending upward from a rear end of the support base 2 and an arm 4 extending frontward from an upper end of the pillar 3. The support base 2 is formed into substantially a U-shape and has two legs 2*a* extending forward from right and left portions thereof and an open front as viewed from above. The support base 2 further has a cylinder bed 5 which is formed integrally therewith and extends forward from the central rear thereof.

Figures 2A, 2B:
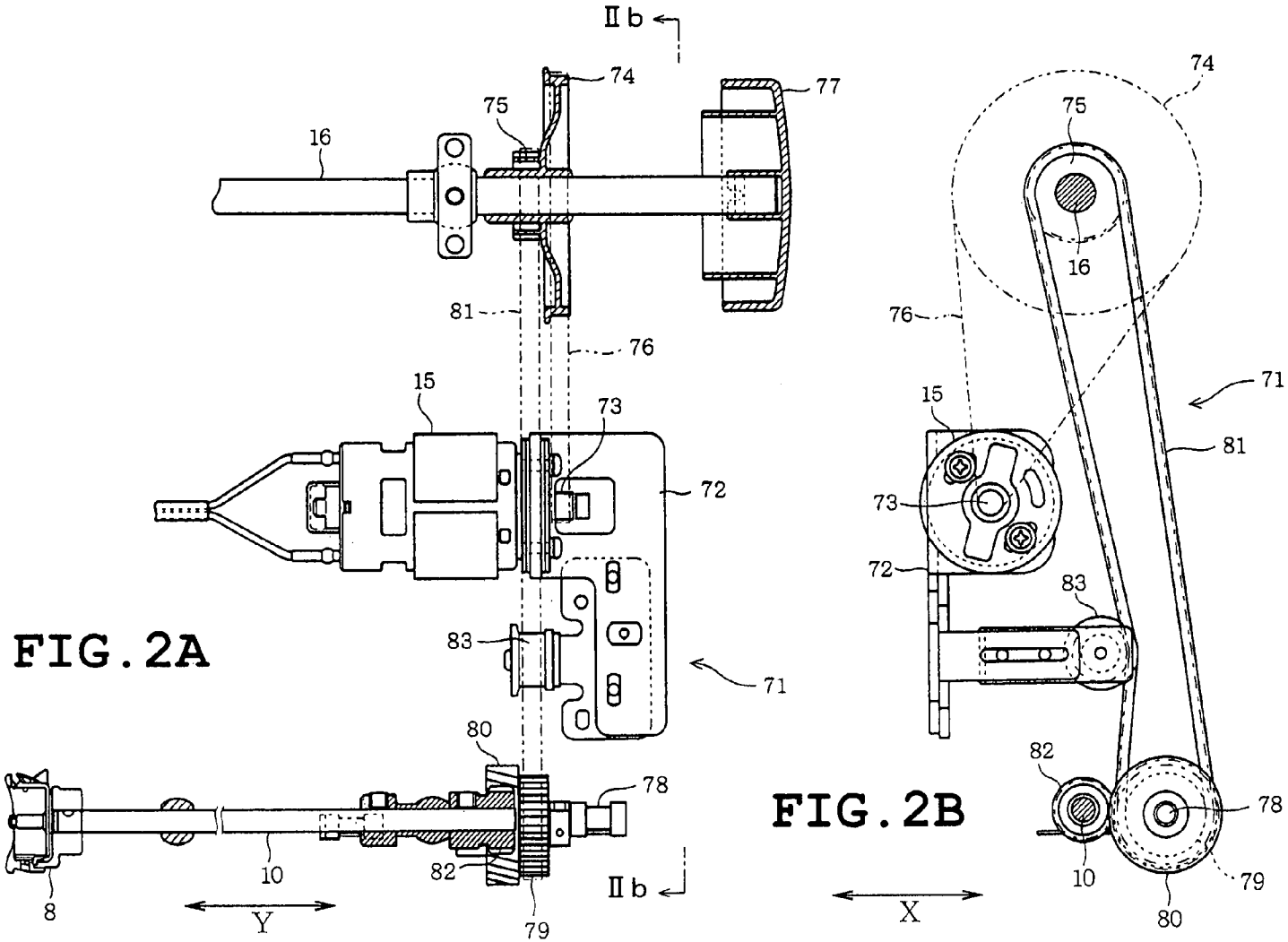
FIG. 2A is a schematically longitudinally sectional side view of a power transmission mechanism.
FIG. 2B is a view taken along line IIb-IIb in FIG. 2A.
Figure 3A:
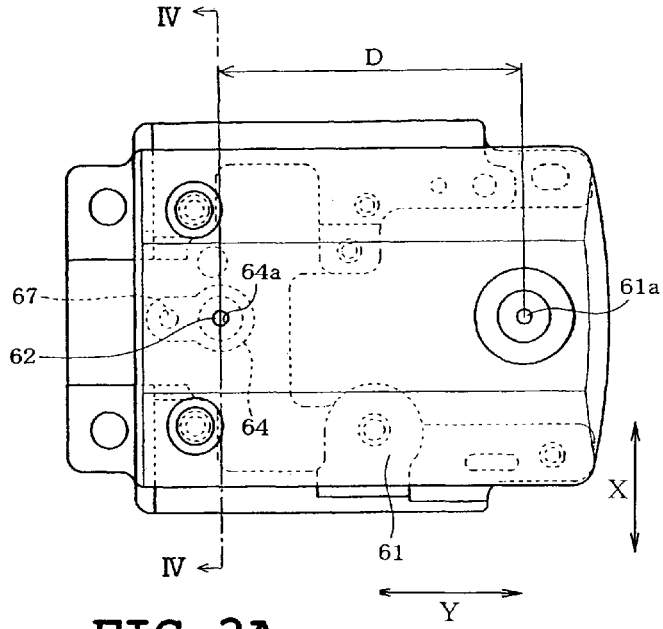
FIGS. 3A and 3B are a plan view and a longitudinal left side section of a striking needle plate.
Figure 3B:
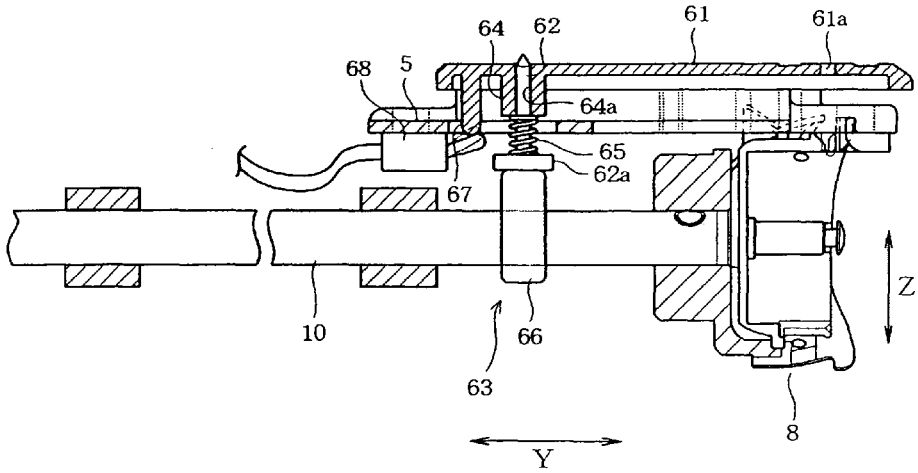

A needle plate is detachably mounted on an upper part of the distal end of the cylinder bed 5, for example, by screws. In the embodiment, a sewing needle plate 6 having a needle hole 6*a* or a striking needle plate 61 (see FIG. 3) which will be described later is adapted to be selectively mounted replaceably. A rotary hook 8 is provided in the cylinder bed 5 so as to be located below the needle plate as shown in FIGS. 2A and 3B though a detailed description thereof will be eliminated. A drive shaft (lower shaft) to drive the rotary hook 8 extends in the front-rear direction. Furthermore, the cylinder bed 5 encloses a thread loop seizing beak, a thread cutting mechanism, a picker and the like although none of them are shown.

A spool device on which, for example, six thread spools are settable is mounted on an upper rear of the arm 4 although not shown. An operation panel is provided on the right of the arm 4 although not shown. On the operation panel are provided a plurality of operation switches 45 which are operated by the user or operator for operation of various instructions, selection and input and a liquid crystal display (abbreviated as LCD in FIG. 7) 46 as shown in only FIG. 7.

A needle bar case 7 is mounted on a distal end of the arm 4 so as to be movable in the right-left direction (the X direction) as shown in FIG. 1. The needle bar case 7 is formed into the shape of a generally rectangular box that is thin in the front-back direction. A plurality of, for example, six needle bars which are lined, up in the right-left direction are movable upward and downward. Each needle bar is normally urged toward a needle-up position or an upper dead point by a coil spring that is not shown. The needle bars have lower ends on which embroidery needles 9 are detachably mounted. The needle bars have lower portions on which are mounted embroidery presser feet 11 which are moved upward and downward in synchronization with upward and downward movement of the needle bars respectively.

Needle bar Nos. 1, 2 and so on are assigned to the needles sequentially from the right one when the six needle bars need to be identified from one another. In the embodiment, an engraving needle is attached to a specified leftmost needle bar No. 6. When an engraving operation is to be executed in an engraving mode, the needle 9 and the embroidery presser foot 11 are detached from the needle bar No. 6. Furthermore, six thread take-up levers are provided in the upper interior of the needle bar case 7 so as to correspond to the respective needle bars although not shown. The thread take-up levers have distal ends protruding forward through six vertical slits 12 formed in the front surface of the needle bar case 7, thereby being swung up and down in synchronization with the upward and downward movement of the needle bars respectively. Additionally, a wiper is provided in the rear of the needle bar occupying the position where the needle bar is moved up and down by a needle bar upward and downward driving mechanism which will be described later.

The needle bar case 7 includes an upper cover 13 which is formed integrally therewith and extends obliquely rearward from an upper end thereof as shown in FIG. 1. Six thread tensioners (only mounting holes therefor are shown) and six thread breakage sensors 14 are located on an upper end of the upper cover 13. As the result of the above-described construction, needle threads for embroidery sewing are drawn from respective thread spools set on a spool device and passed through respective thread breakage sensors 14, thread tensioners, thread take-up levers and the like sequentially. The needle threads are finally passed through the eyes of the needles 9 respectively, whereupon the embroidery sewing is executable. In this case, when different colors of threads are supplied to six or five needles 9, an embroidery sewing operation can continuously be carried out while the threads are automatically changed.

A sewing machine motor 15 is provided in the pillar 3 as shown in FIG. 2. In the arm 4 are provided a main shaft 16 driven by the sewing machine motor 15, a needle bar driving mechanism which is driven by rotation of the main shaft 16 thereby to move the needle bars and the like upward and downward, a needle bar selecting mechanism which moves the needle bar case 7 in the X direction to select one of the needle bars, and the like. The needle bar driving mechanism converts rotation of the main shaft 16 to upward and downward movement of each needle bar and includes an upward and downward moving member which is selectively engaged with a needle bar bracket of each needle bar, although the structure is not shown. In this case, each needle bar is moved upward and downward once in synchronization with one turn of the main shaft 16. The needle bar selecting mechanism is driven by a needle bar selecting motor 17 (shown only in FIG. 7) to transfer the needle bar case 7 in the X direction so that any one of the needle bars located right above the needle hole 6*a* is engaged with the upward and downward moving member. The needle bar selecting mechanism is thus constructed, and the needle bar driving mechanism moves upward and downward only the selected needle bar and the thread take-up lever and the embroidery presser foot 11 both corresponding to the selected needle bar.

A power transmission mechanism 71 incorporated in the sewing machine body 1 will be described in brief with reference to FIGS. 2A and 2B. The power transmission mechanism 71 transmits drive force of the sewing machine motor 15 to the main shaft 16 and the drive shaft 10 thereby to drive the shafts 16 and 10 in a synchronous manner. More specifically, the sewing machine motor 15 is mounted via a motor bracket 72 on the vertical middle of the pillar 3 so as to be directed rearward. The sewing machine motor 15 has a rotational shaft to which a driving pulley 73 comprising a timing pulley is secured. To the rear end side portion of the main shaft 16 are secured a first timing pulley 74 having a larger diameter and a second timing pulley 75 having a smaller diameter and incorporated with the first timing pulley 74. A timing belt 76 extends between the driving pulley 73 and the first timing pulley 74. A hand pulley 77 is mounted on the rear end of the main shaft 16 in order that the user may manually rotate the main shaft 16.

An idle shaft 78 is rotatably mounted near the rear end of the driving shaft 10 (the right side as viewed in FIG. 2B) so as to extend in the front-rear direction in parallel with the driving shaft 10. To the idle shaft 78 are integrally secured a driven pulley 79 comprising a timing shaft having the same diameter as the second timing pulley 75 and a driving pulley 80. A second timing belt 81 extends between the second timing pulley 75 and the driven pulley 79. A lower shaft gear 82 is secured to the driving shaft 10 and is in mesh engagement with the driving gear 80. The motor bracket 72 is provided with an idle pulley 83 which is brought into contact with the second timing belt 81 thereby to impart tension to the belt 81.

A gear ratio of the lower shaft gear 82 to the driving gear 80 is set to 1:2. As a result, the main shaft 16 is rotated upon drive of the sewing machine motor 15, and the driving shaft 10 is also rotated synchronously. The number of revolutions of the driving shaft 10 is twice as large as the number of revolutions of the main shaft 16. Accordingly, the driving shaft 10 and accordingly the rotary hook 8 fixed to the driving shaft 10 are rotated two turns while the main shaft is rotated one turn or the needle bar is moved upward and downward once. A vertical position of the needle bar corresponds to rotational phases of the main shaft 16, the driving shaft 10 and the rotary hook 8.

A rotation angle sensor 47 (shown only in FIG. 7) is provided on the main shaft 16 for detecting a rotational phase (angle) of the main shaft 16 although not shown and described in detail. The rotation angle sensor 47 comprises a plurality of angular shutters secured to the main shaft 16 and a plurality of optical sensors detecting rotational states of the angular shutters. A detection signal generated by each sensor 47 is delivered to the control circuit 41, so that a rotational phase of the main shaft 16 and the vertical position of each needle bar are detected.

A carriage 19 constituting a transfer mechanism (see FIG. 7) is located slightly above the cylinder bed 5 on the support base 2 in front of the pillar 3 as shown in FIG. 1. A holder is detachably connected to the carriage 19. The holder holds the work, that is, workpiece cloth (not shown) on which embroider is to be sewn or engraving work W (see FIGS. 6A to 5C) on which engraving is carried out. In the embodiment, the holder includes a plurality of types of embroidery frames 20 (only one type is shown in FIG. 5) holding the workpiece cloth, a work holder 21 (see FIGS. 5A to 5C) which holds the engraving work W and an striking holder 21 holding the engraving work W, all of which are provided as accessories.

The carriage 19 includes a Y-direction carriage 22, an X-direction carriage 23 mounted on the Y-direction carriage 22 and a frame holder body 24 (shown only in FIG. 5) mounted on the X-direction carriage 23 as shown in FIGS. 1 and 5. The aforesaid transfer mechanism 18 includes a Y-direction drive mechanism which is provided in the support base 2 to move the Y-direction carriage 22 freely in the Y direction (the front-back direction) and an X-direction drive mechanism which is provided in the Y-direction carriage 22 to move the X-direction carriage 23 and the frame holder body 24 in the X-direction (right-left direction). The holder holding the work is held by the frame holder 24 and is freely transferred in two directions or the X and Y directions by the carriage 19.

The Y-direction carriage 22 is formed into the shape of a horizontally long box and extends in the right-left direction (the X direction) so as to bridge between the right and left legs 2*a*. In this case, the legs 2*a* of the support base 2 are formed with respective guide grooves 25 extending in the front-back direction (the Y direction) as shown in FIG. 1. The Y-direction drive mechanism includes two moving members which extend vertically through the guide grooves 25 and are provided so as to be movable in the Y-direction (the front-back direction) along the guide grooves 25, respectively. The Y-direction carriage 22 has right and left ends connected to upper ends of the moving members respectively.

The Y-direction drive mechanism includes a Y-direction drive motor 26 (see FIG. 7) comprising a stepping motor and a linear moving mechanism comprising a timing pulley and a timing belt. The moving member is freely moved by the linear moving mechanism driven by the Y-direction drive motor serving as a drive source, whereby the Y-direction carriage 22 is freely moved in the Y direction.

The X-direction carriage 23 is formed into the shape of a horizontally long plate having a part thereof protruding forward from the lower front of the Y-direction carriage 22 as shown in FIGS. 1 and 5. The X-direction carriage 23 is supported by the Y-direction carriage 22 so as to be slidable in the X direction (the right-left direction). The X-direction drive mechanism provided in the Y-direction carriage 22 includes an X-direction drive motor 27 (see FIG. 6) comprising a stepping motor) and a linear moving mechanism comprising a timing pulley and a timing belt. The X-direction drive mechanism freely moves the X-direction carriage 23 in the X direction.

The following will describe the frame holder body 24 mounted on the X-direction carriage 23 and the holder detachably attached to the frame holder 24, that is, the embroidery frame 20 and the work holder 21. Firstly, the embroidery frame 20 will be described with reference to FIG. 5. The embroidery frame 20 includes a rounded rectangular inner frame 28, an outer frame 29 detachably fitted with the outer periphery of the inner frame 28 and a pair of connecting portions 30 mounted on right and left ends of the inner frame 28. The workpiece cloth serving as the work is held between the inner and outer frames 28 and 29 so as to be held in a stretched state inside the inner frame 28.

The paired connecting portions 30 have rotational symmetry through 180 degrees in a plan view. The connecting portions 30 are formed with engagement grooves 30*a* and engagement holes 30*b* for attachment to the frame holder 24. A plurality of types of embroidery frames 20 differing in the size and shape (embroidery area) from one another are prepared and are selectively used according to a size of embroidery pattern. Furthermore, the width L1 or the dimension between the outer edges of the connecting portions 30 is set so as to differ from one embroider frame to another according to the type of the connecting portions 30. As a result, detection as to the type of the embroidery frame and detection as to whether the striking holder 21 is executable. FIG. 5 shows an embroidery frame 20 having a largest width L1.

Figure 6A:
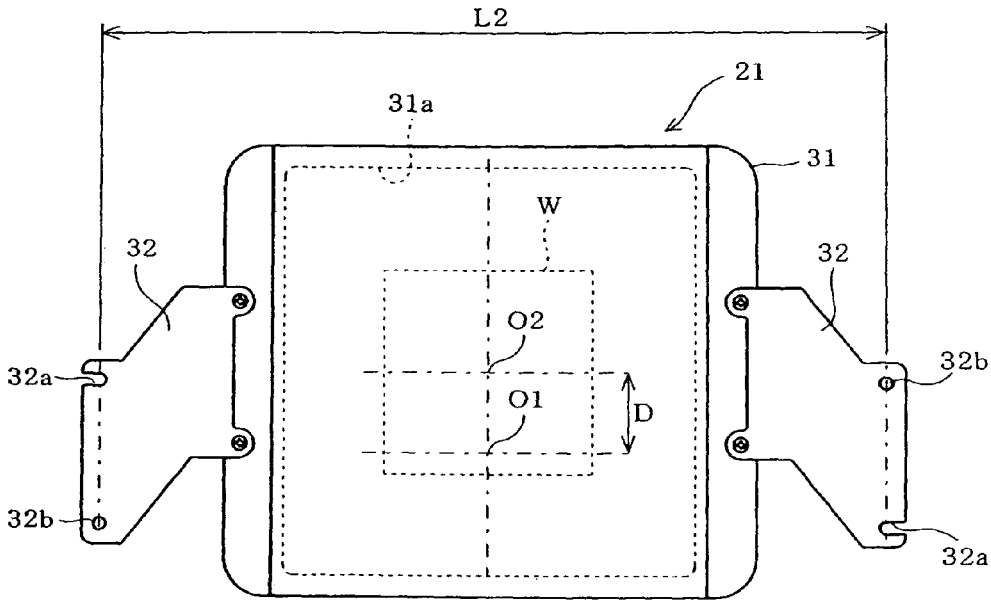
FIGS. 6A and 6B are a plan view and a front view of the stamping holder.
Figure 6B:
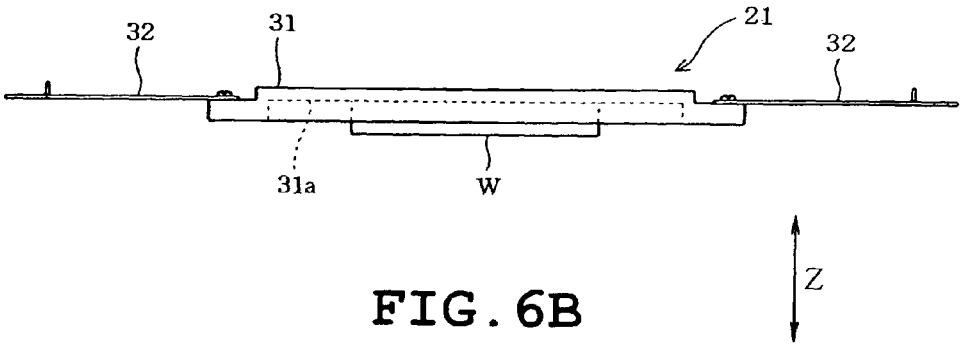

The striking holder 21 will now be described. The striking holder 21 includes a rectangular plate-shaped holding portion 31 having rounded corners and a pair of connecting members 32 attached to right and left ends of the holding portion 31 respectively, as shown in FIGS. 6A and 6B. The holding portion 31 has a bottomed holding recess 31*a* which is located at the underside of the holding portion 31 and is rectangular in shape except for a peripheral frame-shaped portion. The holding recess 31*a* has an upper bottom and includes a fixing unit (not shown) which fixes the engraving workpiece W to the central portion of the holding recess 31*a*. The fixing unit comprises a clamp mechanism which holds the engraving workpiece by clamping two opposed sides of the engraving workpiece or a double-faced adhesive tape.

The engraving workpiece W may be a plate made of a resin such as acrylic, a plate made of a metal such as aluminum or brass, a wooden plate or plyboard, or a board made by solidifying a fibrous material, for example. The workpiece W made of one of these materials desired by the user may be used. The engraving workpiece W has a thickness that is larger by a predetermined value than a depth of the holding recess 31*a*. The engraving workpiece W is disposed so that a worked surface thereof or a surface to which engraving is applied is directed downward and so that a rear surface thereof is received by the holding recess 31*a*. The engraving workpiece W is held at a predetermined fixing position of the striking holder 21 by the fixing unit. The paired connecting members 32 have a rotational symmetric structure through 180 degrees as viewed in a plan view. The connecting members 32 are formed with engagement grooves 32*a* and engaging holes 32*b* provided for attachment to the frame holder body 24.

Each connecting member 32 includes an outer portion or attachment portion which is attached to the frame holder body 24 and an inner portion which is connected to a central part of the right or left side of each holding portion 31. The outer and inner portions of each connecting member 32 are displaced from each other in the front-rear direction as shown in FIG. 6A. As a result, an engraving center O2 is displaced rearward by dimension D relative to the embroidery center O1. Furthermore, the width L2 of the striking holder 21 is set so as to differ from the width L1 of each type of embroidery frame 20 as described above. Additionally, a plurality of types of striking holders 21 may be provided according to the size, shape, thickness or the like of the engraving workpiece W.

The frame holder body 24 to which the embroidery frame 20 or the striking holder 2 is attached or connected will be described as follows. The frame holder body 24 is mounted on an upper surface of the X-direction carriage 23 as shown in FIG. 5. The frame holder body 24 includes a fixedly mounted fixed arm 34 and a movable arm 33 which is mounted on the frame holder body 24 so as to be displaceable relative to the body. The position of the movable arm 34 changed in the right-left direction by the user according to the types of the embroidery frame 20 and striking holder 21, that is, the widths L1 and L2 and the like.

The frame holder body 24 formed into the shape of a plate extending in the X direction includes a main part 24*a* having a right end further having an upper surface on which the fixed arm 33 is mounted so as to be laid on the upper surface. The fixed arm 33 has a right arm 33*b* bent substantially at a right angle and extending forward. The right arm 33*b* has an upper surface with a distal end on which an engagement pin 35 is provided, and a leaf spring 36 is mounted so as to be located in the rear of the engagement pin 35. The leaf spring 36 is provided for holding the connecting portion 30. The engagement pin 35 is engaged with the engagement groove 30*a* of the connecting portion 30 of the embroidery frame 20 or the engagement groove 32*a* of the connecting portion 32 of the striking holder 21.

The movable arm 34 is formed so as to be bilaterally symmetric with the right arm 33*b* and has a proximal or rear end mounted on the left upper surface of the main portion 24*a* of the frame holder body 24 so as to overlap the surface. The movable arm 34 has an upper surface provided with an engagement pin 37 located on a distal end thereof. The upper surface of the movable arm 34 further has a leaf spring 38 which is located in the rear of the second engagement pin 37 and provided for holding the connecting portion 30 or 32. The engagement pin 37 is engaged with an engagement groove 30*b* of the connecting portion 30 of the embroidery frame 20 or an engagement groove 32*b* of the connecting portion 32 of the striking holder 21.

The movable arm 34 has a proximal end formed with an elongate guide groove 34*a* which is elongate in the right-left direction. A guide pin 39 is mounted on the upper surface of the main portion 24*a* of the frame holder body 24. The guide pin 39 is engaged with the guide groove 34*a*. As a result, the movable arm 34 is slidable in the right-left direction relative to the main portion 24*a* of the frame holder body 24. Furthermore, the main portion 24*a* of the frame holder body 24 is provided, with a positioning and fixing mechanism (not shown) which selectively fixes the movable arm 34 at one of a plurality of predetermined positions. When the user operates the positioning and fixing mechanism, the position of the movable arm 34 in the right-left direction is changeable.

As the result of the above-described construction, the user attaches the embroidery frame 20 or the striking holder 21 to the frame holder 24 while the movable arm 41 is fixed to a suitable position according to the type of the embroidery frame 20 or the striking holder 21 to be attached, that is, the width L1, L2. In attachment of the embroidery frame 20, the connecting portions 30 of the embroidery frame 20 are inserted between the movable arm 34 and the leaf spring 38 and between the right arm 43 and the leaf spring 36 from the front respectively as exemplified in FIG. 5. The engagement hole 30*b* of the connecting portion 30 is then engaged with the engagement pin 35 of the right arm 33*b*, and the engagement groove 30*a* of the connecting portion 30 is engaged with the engagement pin 37 of the movable arm 34. As a result, the embroidery frame 20 is held by the frame holder body 24 and moved in the X or Y direction by the transfer mechanism 18. The striking holder 21 can also be attached to the frame holder 24 in the same manner as described above.

Figure 7:
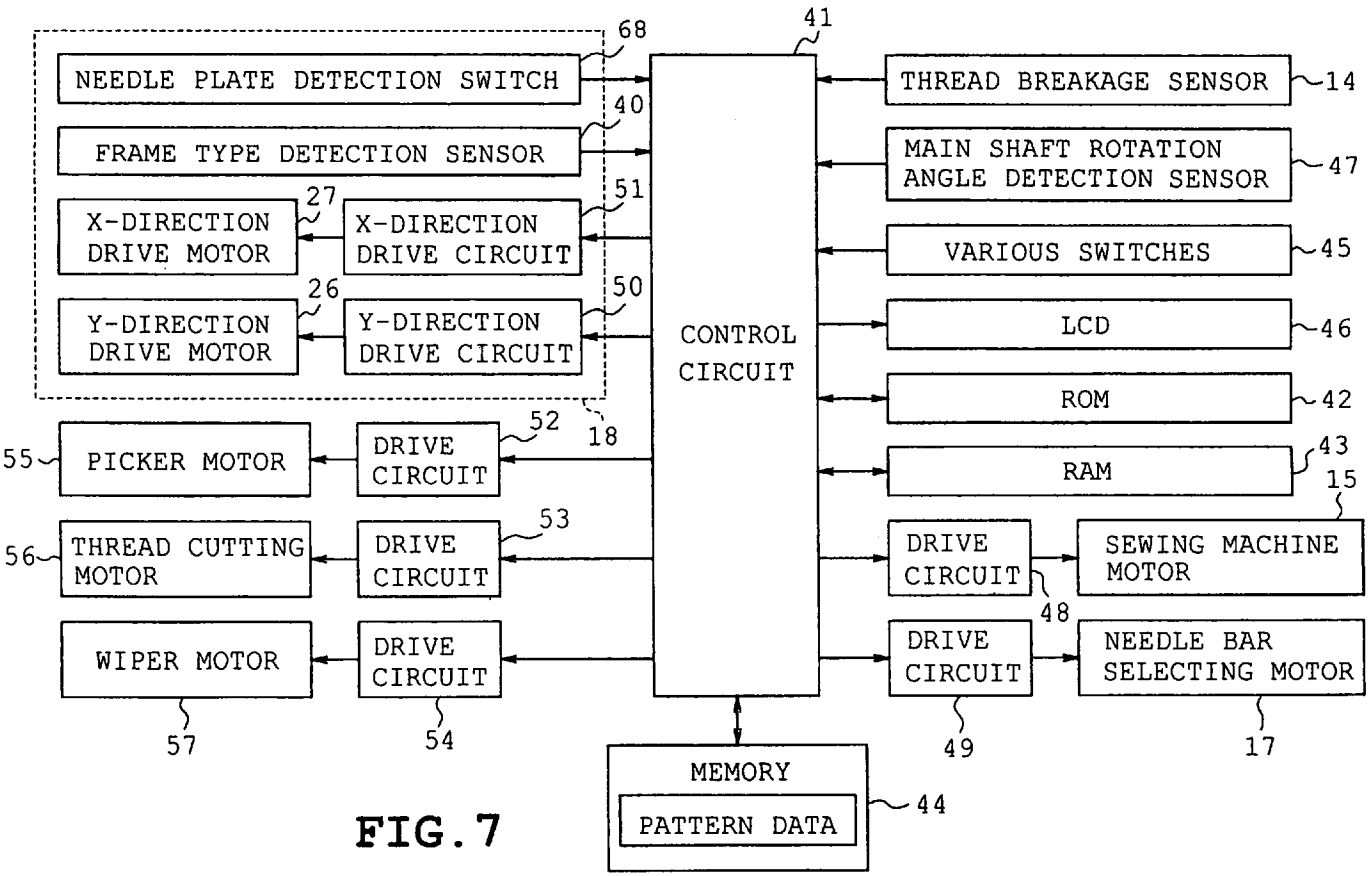
FIG. 7 is a schematic block diagram showing an electrical arrangement of the embroidery machine.

A frame type detector 40 is mounted on the X-direction carriage 23 for detecting the embroidery frame 20 or the striking holder 21 attached to the frame holder body 24 based on a detected position of the movable arm 34, as shown in FIGS. 5 and 7. The frame type detector 40 comprises a rotary potentiometer, for example, and has a detecting element which abuts a detected portion comprising an inclined surface provided on the movable arm 34, for example. The frame type detector 40 changes a resistance value and accordingly an output voltage value according to variations in a rotational angle of the detecting element depending upon the position of the movable arm 34 with respect to the right-left direction.

An output signal generated by the frame type detector 40 is delivered to a control circuit 41 which will be described later, as shown in FIG. 7. The control circuit 41 then determines the frame type between the embroidery frame 20 and the striking holder 21. Accordingly, the frame type detector 40 and the control circuit 41 constitute a detection processing section which detects whether the striking holder 21 has been attached to the transfer mechanism 18.

In the embodiment, the sewing machine body 1 can execute an engraving operation as well as a normal embroidery sewing operation with the use of a workpiece cloth and six colors of embroidery threads. In the engraving operation, the striking needle 62 is struck against the surface of the engraving workpiece W in dots while the striking holder 21 is transferred in the X or Y direction by the transfer mechanism 18, whereby a desired photograph, illustration or character is engraved on the workpiece W. In execution of the engraving operation, a striking needle 62 is attached to the cylinder bed 5 so as to be directed upward and driven upward and downward by a drive mechanism 63 provided in the cylinder bed 5. In the embodiment, the striking needle 62 is provided on a striking needle plate 61 as shown in FIGS. 3A, 3B, 4A and 4B. The striking needle plate 61 is detachably mounted on an upper surface of the distal end of the cylinder bed 5 so as to be substituted for the sewing needle plate 6.

Figure 4A:
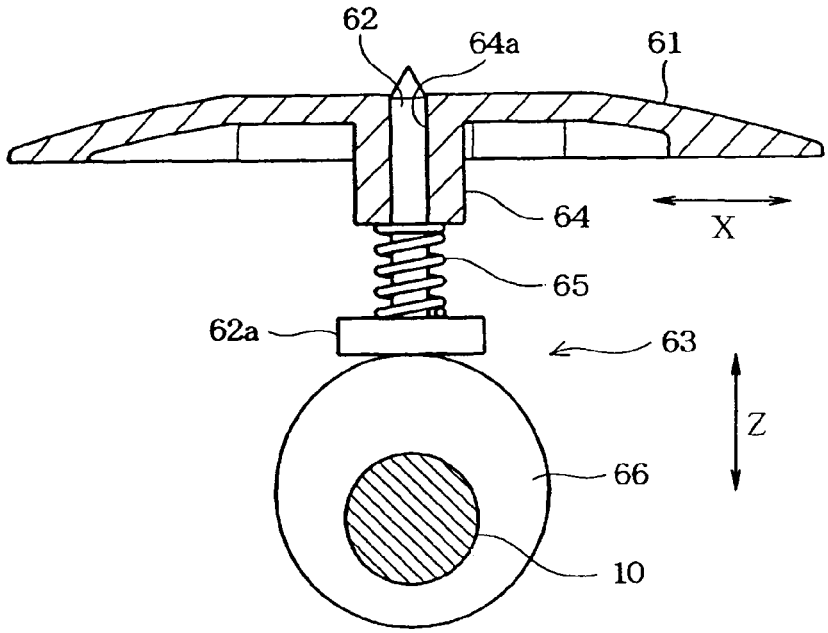
FIG. 4A is a longitudinally sectional front view of a striking needle when the striking needle is located at an uppermost position or a section taken along line IV-IV in FIG. 3A.
Figure 4B:
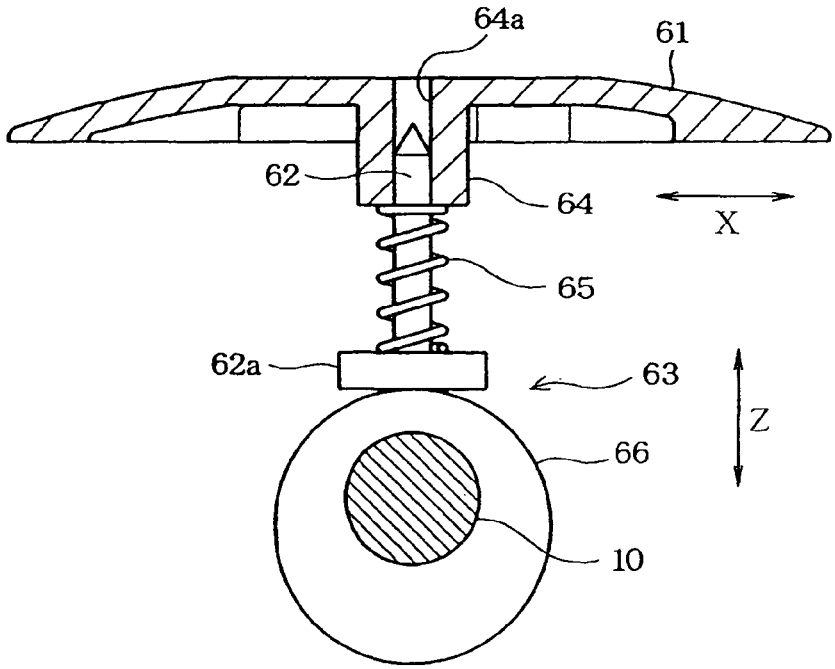
FIG. 4B is a longitudinally sectional front view of a striking needle when the striking needle is located at a lowermost position or a section taken along line IV-IV in FIG. 3A.

The striking needle plate 61 and the drive mechanism 63 will be described in the following. The striking needle plate 61 is formed into the shape of a thin plate having an equivalent profile to the sewing needle plate 6 and includes a distal end side portion provided with a needle hole 61*a* through which the needle 9 is insertable, as shown in FIGS. 3A and 3B. Actually, however, the needle 9 is not inserted through the needle hole 61*a*. A striking needle support 64 is formed integrally with the striking needle plate 61 so that the plate 61 is located at a position spaced by distance D rearward from the needle hole 61*a*, as also shown in FIGS. 4A and 4B as well as in FIGS. 3A and 3B. The striking needle support 64 supports the striking needle 62 so that the striking needle 62 is movable upward and downward or retractable at the aforementioned position. The striking needle support 64 is formed into a cylindrical shape protruding downward from the underside of the striking needle plate 61 and has a through hole 64*a* vertically extending therethrough.

The striking needle 62 is formed into a round bar and includes an acuate distal or upper end suitable for the engraving and on a lower end thereof a disc-shaped bottom 62*a* which is formed integrally with the needle 62. The striking needle 62 is inserted into the through hole 64*a* from below so as to be movable upward and downward. A coil spring 65 is provided around the striking needle 62 so as to be located between the striking needle support 64 and the bottom 62*a*. The coil spring 65 has upper and lower ends secured to the striking needle support 64 and the bottom 62*a* respectively. As a result, the striking needle 62 is normally urged by the spring force of the coil spring 65 downward or in such a direction that the striking needle 62 is brought into the through hole 64*a*.

The drive mechanism 63 includes the drive shaft 10 and a disc-shaped drive cam 66 is mounted on the drive shaft 10 so as to be located beneath the striking needle 62. The drive cam 66 is mounted so as to be eccentric with the drive shaft 10 as shown in FIGS. 4A and 4B. When the striking needle plate 61 is mounted on the cylinder bed 5, the underside of the bottom 62*a* of the striking needle 62 is in abutment with the outer circumferential surface of the drive cam 66. As a result, the striking needle 62 is moved upward and downward by the rotation of the drive shaft 10 and accordingly of the drive cam 66. The upward and downward movement of the striking needle 62 ranges between an uppermost position where a distal end of the striking needle 62 protrudes from the upper surface of the striking needle plate 61 as shown in FIG. 4A and a lowermost position where the distal end of the striking needle 62 is withdrawn into the through hole 64*a*. In this case, the striking needle 62 is moved upward and downward once by one turn of the drive shaft 10.

The striking needle plate 61 further has a detection protrusion 67 which is formed on the rear end thereof so as to protrude downward as shown in FIG. 3B. A needle plate detection switch 68 is provided in the cylinder bed 5 for detecting the detection protrusion 67. The needle plate detection switch 68 is turned on by the detection protrusion 67 when the striking needle plate 61 has been mounted to the striking needle 62, for example. A detection signal generated by the needle plate detection switch 68 is delivered to the control circuit 41 as shown in FIG. 7. A second detection unit is thus constructed to detect the mounting of the striking needle plate 61 on the cylinder bed 5.

The sewing needle plate 6 is provided with nothing corresponding to the detection protrusion 67 but with a space, instead of the detection protrusion 67. Accordingly, the needle plate detection switch 68 is not operated when the sewing needle plate 6 has been mounted on the cylinder bed 5. Furthermore, the drive cam 66 runs idle without interference with another part when the sewing needle plate 6 has been mounted on the cylinder bed 5. Additionally, needle bar No. 6 is selected out of the six needle bars in execution of the engraving operation. The needle 9 and the presser foot 11 have already been detached from needle bar No. 6. Alternatively, the sewing machine may be turned into a release state where the driving force of the main shaft 16 is not transmitted to any needle bars.

An electrical arrangement of the multineedle sewing machine will schematically be described with reference to FIG. 7. The control circuit 41 serving as a control device mainly comprises a computer or a CPU. A ROM 42, a RAM 43 and an external memory 44 are connected to the control circuit 41. On the ROM 42 are stored an embroidery sewing control program, an engraving control program, various control data and the like. On the external memory 44 are stored pattern data for sewing various types of embroideries, engraving pattern data and the like.

Operation signals are supplied from various operation switches 45 on the operation panel into the control circuit 41, and the control circuit 41 controls display on the liquid-crystal display 46. While viewing the displayed contents on the liquid crystal display 46, the user then operates the operation switches 45 to select an operation mode of the sewing machine (an embroidery sewing mode, engraving mode and the like) or to designate an embroidery pattern or engraving pattern.

To the control circuit 41 are also supplied detection signals from the respective thread breakage sensors 14, the frame type sensor 40, the needle plate detection switch 68 and the main shaft rotation angle sensor 47. The control circuit 41 controls the sewing machine motor 15 via the drive circuit 48 and also controls the needle bar selecting motor 17 via the drive circuit 49. The control circuit 41 then controls the Y-direction drive motor 26 of the transfer mechanism 18 via the drive circuit 50 and the X-direction drive motor 27 via the drive circuit 51. As a result, the frame holder body 24 and accordingly the embroidery frame 20 or the striking holder 21 are freely moved. Furthermore, the control circuit 41 controls a picker motor 55 serving as a drive source for a picker (not shown), a thread cutting motor 56 serving as a drive source for a threading mechanism and a wiper motor 57 serving as a drive source for a wiper (not shown) via the respective drive circuits 52, 53 and 54, thereby executing a thread cutting operation.

The control circuit 41 executes the embroidery sewing control program or the embroidery sewing mode thereby to automatically execute an embroidery sewing operation for the workpiece cloth held on the embroidery frame 20. In this case, the user selects desired embroidery data from embroidery sewing pattern data stored on the external memory 44, for example. The embroidery sewing operation is executed by controlling the sewing machine motor 15, the needle bar selecting motor 17, the Y-direction drive motor 26 and the X-direction drive motor 27 of the transfer mechanism 18 based on selected pattern data.

In the embroidery sewing mode, the embroidery frame 20 attached to the frame holder body 24 is moved by the transfer mechanism 18 based on the detection of a main shaft rotation angle sensor 47 in synchronization with the raised state of the needle bar. The above-mentioned embroidery sewing pattern data includes one stitch data indicative of a needle location for every stitch (movement amounts of the embroidery frame 20 in the X and Y directions), color change data indicative of change in the color of the embroidery thread or in the needle bar to be driven, thread cutting data indicative of a thread cutting operation, sewing end data and the like.

In the embodiment, the control circuit 41 is arranged to execute a software arrangement or an engraving control program thereby to automatically execute the engraving operation based on the engraving pattern data. The engraving operation is executed by controlling the sewing machine motor 15, the needle bar selecting motor 17, X and Y direction drive motors 26 and 27 of the transfer mechanism 18 and the like are controlled. This operation mode in which the engraving operation is automatically executed will be referred to as "engraving mode." The engraving pattern data mainly comprises aggregate of transfer data indicative of X and Y direction movement amounts of the workpiece W or striking holder 21 for every position of a striking point of the striking needle 62 in every engraving operation or for every upward and downward movement of the striking needle 62.

In the engraving operation, the engraving workpiece W held by the striking holder 21 is repeatedly moved to a next engraving point by the transfer mechanism 18 during downward movement of the striking needle 62 while the striking needle 62 is moved upward and downward by the drive mechanism 63. The needle bar No. 6 is selected by the needle bar selecting motor 17 in the engraving mode as described above. Since the needle 9 and the presser foot 11 have been detached from needle bar No. 6, the needle bar does not act on the engraving workpiece W. Of course, the needle bar does not block the movement of the striking holder 21.

Since the drive shaft 10 is synchronously rotated at a speed twice as high as the main shaft 16, the striking needle 62 is moved upward and downward twice while the main shaft 16 is rotated one turn. The control circuit 41 controls the sewing machine in the engraving mode so that the engraving workpiece or the striking holder 21 is moved in synchronization with the descended state of the engraving needle 62 based on the detection of the main shaft rotation angle sensor 47. More specifically, the engraving mode differs from the embroidery sewing mode in that the control circuit 41 controls the transfer mechanism 18 so that the striking holder 21 is moved to a next striking point in a predetermined phase appears twice during one turn of the main shaft 16.

When executing the engraving operation, the control circuit 41 retrieves detection signals of the frame type sensor and the needle plate detection switch 68, as will be described later in the description of operation with reference to the flowchart of FIG. 8. The control circuit 41 starts the engraving operation on condition that attachment of the striking holder 21 to the frame holder body 24 has been detected by the frame type sensor 40 and that the mounting of the engraving needle plate 61 on the cylinder bed 5 has been detected by the needle plate detection switch 68. The control circuit 41 starts an embroidery sewing operation on condition that the attachment of the embroidery frame 20 to the frame holder 24 has been detected by the frame type sensor 40.

Furthermore, the control circuit 41 prohibits execution of the engraving operation and the embroidery sewing operation when the mounting of the engraving needle plate 61 has not been detected by the needle plate detection switch 68 in spite of detection of the mounting of the striking holder 21 by the frame type sensor 40. The control circuit 41 also prohibits execution of the engraving operation and the embroidery sewing operation when the mounting of the striking holder 21 has not been detected by the needle plate detection switch 68 in spite of detection of the mounting of the engraving needle plate 61 by the needle plate detection switch 68. In these cases, the user is informed of occurrence of an error by display of the liquid crystal display 46, for example. Alternatively, a buzzer may be provided so that the buzzer is activated to inform the user of occurrence of an error. The control circuit 41 thus serves as an informing unit together with the liquid crystal display 46 or the buzzer.

The multineedle embroidery sewing machine constructed and arranged above will work as follows. Reference is further made to FIG. 8. When the embroidery sewing operation is to be executed, the user attaches to the frame holder body 24 the embroidery frame 20 holding the workpiece cloth serving as the workpiece while the sewing needle plate 6 is mounted on the upper surface of the cylinder bed 5. The embroidery sewing operation is executed by controlling the needle bar selecting motor 17 by the control circuit 41 so that the needle bar to which the needle 9 has been attached is selectively driven, while the transfer mechanism 18 is controlled so that the embroidery frame 20 is freely moved in the X and Y directions based on the pattern data.

On the other hand, when the user wishes to execute an engraving operation on the engraving workpiece W, the engraving workpiece W is held by the striking holder 21 with a surface to be worked being directed downward, and the striking holder 21 is attached to the transfer mechanism 18. With this, the user mounts the engraving needle plate 61 on the upper surface of the cylinder bed 5 instead of the sewing needle plate 6. Furthermore, the needle 9 and the presser foot 11 of needle bar No. 6 are detached. As a result, the engraving operation is executable.

In the above-described case, based on the engraving pattern data selected by the user, the control circuit 41 controls the transfer mechanism 18 so that the striking holder 21 or the engraving workpiece W is freely moved in the X and Y directions. The drive shaft 10 is rotated by the sewing machine motor 15 in synchronization with the movement of the engraving workpiece W so that the striking needle 62 is moved upward and downward by the drive mechanism 63 for execution of the engraving operation. As a result, the striking needle 62 is struck onto the surface of the engraving workpiece W by dot so that a pattern according to the engraving pattern data is engraved on the workpiece W. Neither needle 9 nor presser foot 11 is provided on needle bar No. 6 although needle bar No. 6 is selected by the needle bar selecting mechanism and moved upward and downward in the engraving operation. Consequently, the engraving workpiece W can be prevented from being adversely affected by needle bar No. 6.

If the striking needle should be attached to the needle bar and moved upward and downward in the above-described case, the number of times of the upward and downward movement of the striking needle would be equal to the number of revolutions of the main shaft 16. On the other hand, in the embodiment, the drive mechanism 63 includes the drive shaft 10 and is constructed so that the drive shaft 10 is rotated at a rotational speed twice as high as that of the main shaft 16 and so that the striking needle 62 is moved upward and downward by the drive cam 66 with use of the drive shaft 10. As a result, the number of times of upward and downward movement of the striking needle 62 can be rendered twice as large as that in the case where the engraving is executed with the use of a needle bar. This can sufficiently increase the engraving efficiency.

It can be considered that due to an erroneous operation by the use, an embroidery sewing operation would be executed with the use of a needle 9 for the sewing operation with the striking holder 21 being mounted on the frame holder 24. In this case, the needle 9 would collide with the striking holder 21 with the result of damage to the needle 9, the striking holder 21 and the like. Furthermore, the embroidery frame 20 would be damaged by the striking needle 62 if the engraving operation by the striking needle 62 should be executed with the embroidery frame 20 holding the workpiece cloth being attached to the frame holder body 24.

Figure 8:
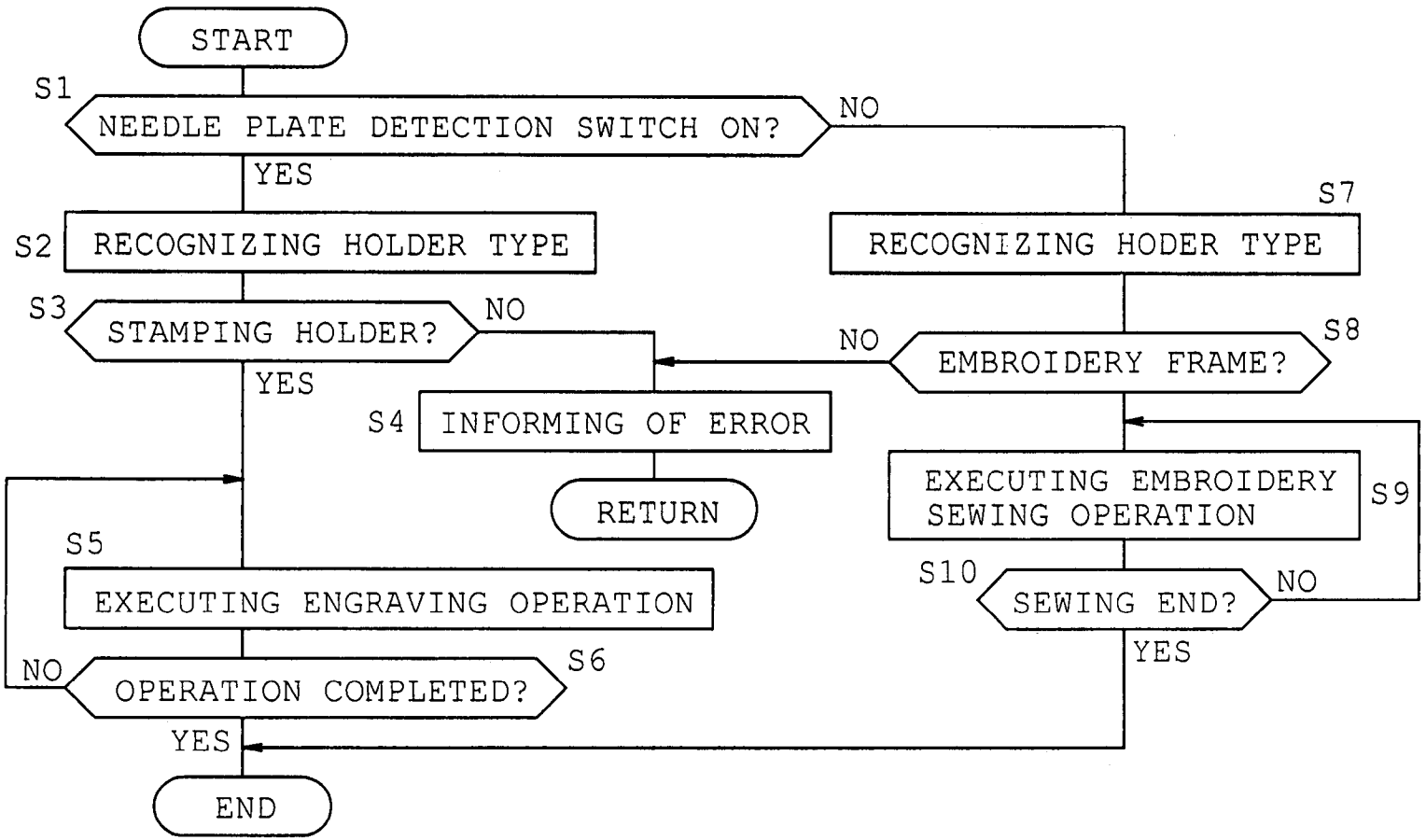
FIG. 8 is a flowchart showing a control procedure executed by a control device.

In view of the above-mentioned problems, the control circuit 41 controls an operation of the sewing machine based on the result of detection by the frame type sensor 40 and the needle plate detection switch 68 in a manner as shown in the flowchart of FIG. 8 when starting the sewing machine motor 15 thereby to start the operation. More specifically, the control circuit 41 determines whether the striking needle plate 61 has been mounted, based on an output signal of the needle plate detection switch 68, at step S1. When the needle plate detection switch 68 is turned on, it can be determined that the striking needle plate 61 has been mounted on the cylinder bed 5 (YES at step S1). In this case, the control circuit 41 advances to step S2 to recognize the types of the embroidery frame 20 and the striking holder 21, based on the output signal of the frame type sensor 40.

At step S3, the control circuit 41 determines whether the striking holder 21 has been attached. When determining at step S3 that the striking holder 21 has not been attached, that is, when the embroidery frame 20 has been attached (NO at step S3), the control circuit 41 advances to step S4 to inform of an error. The informing of the error prompts the user to change the needle plate or the holder. In this case, the sewing machine motor 15 does not start up such that neither embroidery sewing operation nor engraving operation is executed, whereupon the processing is terminated.

On the other hand, when determining that the striking holder 21 has been attached to the frame holder 24 (YES at step S3), the control circuit 41 advances to step S5 to execute the engraving operation by the striking needle 62. When determining that the sewing operation has been terminated or finish data has been read (YES at step S6), the control circuit 41 terminates the operation of the sewing machine.

When the needle plate detection switch 68 is turned off (NO at step S1), it can be determined that the sewing needle plate 6 has been mounted on the cylinder bed 5. In this case, the control circuit 41 advances to step S7 to recognize the types of the embroidery frame 20 and striking holder 21, based on an output signal of the frame type sensor 40. The control circuit 41 determines at step S8 whether the embroidery frame 20 has been attached. When determining that the embroidery frame 20 has not been attached (NO at step S8), the control circuit 41 advances to step S4 to inform of an error.

When determining that the embroidery frame 20 has been attached (YES at step S8), the control circuit 41 advances to step S9 to execute the embroidery sewing operation by the needle 9. Upon finish of the sewing (YES at step S10), the processing is finished. In this case, the type of the embroidery frame 20 can be detected in the recognizing process at step S7 although the detection is not shown in the drawings. Accordingly, the control circuit 41 informs of an error when, for example, the size of the selected embroidery frame data is larger than a sewing area of the embroidery frame 20 as shown by imaginary line in FIG. 5, the control circuit 41 informs of an error or carries out another processing. Thus, the control circuit 41 can execute control according to the type of the embroidery frame 20 mounted.

The above-described control manner of the control circuit 41 can prevent an erroneous operation in which an embroidery sewing operation is executed while the striking holder 21 is attached to the frame holder 24, that is, the embroidery frame 20 is not attached. The above-described control manner can prevent another erroneous operation in which an embroidery sewing operation is executed while the striking needle plate 61 is mounted on the cylinder bed 5. The above-described control manner can prevent further another erroneous operation in which an engraving operation is executed while the embroidery frame 20 is attached to the frame holder body 24. The above-described control manner can prevent still further another erroneous operation in which an engraving operation is executed while the sewing needle plate 6 is mounted on the cylinder bed 5, that is, while the striking needle plate 61 is not mounted.

According to the foregoing embodiment, the striking needle 5 and the drive mechanism 63 are provided on the cylinder bed 5. The striking holder 21 holds the workpiece W to be engraved, so that the workpiece W is directed downward, and is constructed so as to be moved by the transfer mechanism 18 based on the engraving embroidery pattern data. As a result, the engraving operation can be executed on the surface of the workpiece W in addition to the normal embroidery sewing operation on the workpiece cloth. Thus, the multineedle embroidery sewing machine can be used as a device for executing an engraving operation. Furthermore, since the striking needle 62 is located below the workpiece W, the striking needle 62 is prevented from being exposed during the operation thereof. More specifically, the user is prevented from erroneously touching the striking needle 62 in operation, whereupon the engraving operation can be executed safely.

The drive mechanism 63 includes the drive shaft 10 for driving the rotary hook 8 provided in the cylinder bed 5 and the drive cam 66 which is mounted on the drive shaft 10 so as to abut against the lower ends of the striking needle 62 so that the striking needle 62 is moved upward and downward. Consequently, the construction of the drive mechanism 63 can be simplified. Moreover, the striking needle 62 can be moved upward and downward twice per turn of the main shaft 16. As a result, an efficient engraving can be carried out while the rotational speeds of the main shaft 16 and the sewing machine motor 15 driving the main shaft 16 can be rendered relatively lower. In this case, the durability of the drive mechanism, the sewing machine motor 15 and the like can be improved.

Particularly in the embodiment, the striking needle plate 61 has the striking needle support 64 on which the striking needle 62 is supported so as to be movable upward and downward. The striking needle plate 61 is replaceably mounted on the cylinder bed 5. Accordingly, the striking needle plate 61 is mounted instead of the sewing needle plate 6 only when the user wishes the engraving operation to be executed. Since the striking needle 62 is not mounted on the cylinder bed 5 in the other occasions such as execution of an embroidery sewing operation, the striking needle 62 can be prevented from hindering and from carrying out an unnecessary operation. Furthermore, the safety can be ensured.

In the above-described case, when the attachment of the striking holder 21 and the mounting of the striking needle plate 61 have been detected by the frame type sensor 40 and the needle plate detection switch 68 respectively, the control circuit 41 controls the sewing machine so that an engraving operation is executed. Accordingly, the control circuit 41 reliably executes the engraving operation only when the sewing machine is under the condition where the striking operation is executable. Furthermore, when the combination of the types of the holders 20 and 21 and the needle plates 6 and 61 is improper, an improper operation can be prevented from execution. With this, the user can be informed of an error and accordingly, the working can be carried out more safely.

In order that the same pattern as an embroidery pattern may be engraved, the sewing machine can be constructed and arranged so that pattern data for the engraving is originated from the pattern data of an embroidery pattern by the sewing machine or a personal computer discrete from the sewing machine, although this has not been described in the foregoing embodiment. In this case, only transfer data which is used to drive the transfer mechanism 18 is extracted from pattern data of embroidery pattern. More specifically, engraving pattern data can be originated by deleting unnecessary data such as color change data and thread cutting data. Consequently, the process of originating engraving pattern data can be simplified. The engraving pattern data may be stored on the external memory 44 or the ROM 42 beforehand or may be originated by an originating device such as a discrete personal computer thereby to be externally supplied to the sewing machine.

The foregoing embodiment should not be restrictive but may be expanded or modified in various respects. For example, the rotary potentiometer is employed as the first detection unit or the frame type sensor 40 which detects the position of the movable arm 34 of the frame holder body 24 in the foregoing embodiment. In addition, various sensors may be employed which include an optical sensor, a magnetic sensor and a microswitch. In this case, the type of the embroidery frame 20 or the striking holder 21 may directly be detected instead of indirect detection at the position of the movable arm 34. Furthermore, only either embroidery frame 20 or striking holder 21 may be detected.

The second detection unit should not be limited to the needle plate detection switch 68. Various sensors may be employed for the same purpose. In this case, too, the second detection unit may be arranged to discriminate between the sewing needle plate 6 and the striking needle plate 61. Furthermore, a needle sensor may be provided to detect whether the needle 9 and the presser foot 11 have been attached to a specific needle bar or needle bar No. 6 in the foregoing embodiment. In this case, when attachment of the needle 9 has been detected in execution of the engraving operation by the user, the sewing machine may be constructed and arranged so that the engraving operation is forbidden and the user is informed of the forbidding of the engraving operation.

The drive mechanism 63 to drive the striking needle 62 upward and downward comprises the drive shaft 10 and the drive cam 66 mounted on the drive shaft 10 in the foregoing embodiment. However, the drive mechanism can be modified into various forms. For example, a cam mechanism may be provided for moving the striking needle 62 upward and downward twice per turn of the drive shaft 10 as a mechanism for converting rotation of the drive shaft 10 into upward and downward movement of the striking needle 62. In this case, the striking needle 62 can be moved upward and downward four times per turn of the main shaft 16.

Furthermore, the striking needle plate 61 having the striking needle 62 is detachably mounted on the cylinder bed 5 in the foregoing embodiment. The striking needle 62 may normally be disposed on the needle plate side without use of the above-described striking needle plate 61, instead. In this case, the striking needle 62 can be coupled to the drive mechanism 63 thereby to be moved upward and downward if necessary or only when the engraving operation is executed. Additionally, the distal end of the striking needle 62 may be covered by a cover, a cap or the like when the engraving is not executed, that is, when the embroidery sewing operation is executed.

The number of needle bars provided in the needle bar case 7 may be nine, twelve or the like. Furthermore, the foregoing embodiment may be applied to a household embroidery sewing machine which has a single needle bar and can perform embroidery sewing, instead of the above-described multi-needle embroidery sewing machine. Additionally, various modifications may be made into an overall structure of the sewing machine body 1, the structures of the power transmission mechanism 71, the striking holder 21, the transfer mechanism 18 (the carriage 19) and the like.

In the foregoing embodiment, the sewing machine is usable in any one of the following modes. In a first mode, both embroidery frame 20 and striking holder 21 are attached to the transfer mechanism 18 so that both workpieces are processed together. In the second mode, both embroidery frame 20 and striking holder 21 are attached to the transfer mechanism 18 so that either workpiece is processed. In a third mode, either embroidery frame 20 or striking holder 21 is attached to the transfer mechanism 18 so that the workpiece held on either embroidery frame 20 or striking holder 21 attached to the sewing machine is processed.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. A sewing machine comprising:

a sewing machine bed;

a holder configured to hold either one of an embroidery frame that is configured to hold a workpiece cloth or a striking holder that is configured to hold an engraving workpiece that is configured to be engraved by striking;

a transfer mechanism which is detachably attached to the embroidery frame or the striking holder to transfer the embroidery frame or the striking holder freely in a predetermined direction on the sewing machine bed;

a striking needle that is configured to strike against the engraving workpiece thereby to engrave the engraving workpiece when the holder holds the striking holder;

a drive mechanism which reciprocally drives the striking needle upward and downward, from below, toward region where the engraving workpiece is held by the striking holder; and a control device which controls execution of an embroidery sewing operation onto the workpiece cloth or execution of an engraving operation in which the striking needle is moved upward and downward by the drive mechanism so that the striking needle is struck against the engraving workpiece held by the striking holder, from below, while the striking holder is moved by the transfer mechanism.

2. The sewing machine according to claim 1, wherein the drive mechanism includes a drive shaft which drives a rotary hook provided in the sewing machine bed and a drive cam which is mounted on the drive shaft so as to be adjacent to a lower end of the striking needle so that the striking needle is moved upward and downward.

3. The sewing machine according to claim 1, further comprising a striking needle plate which is detachably mounted on the sewing machine bed, wherein the striking needle is supported on the striking needle plate so as to be movable upward and downward.

4. The sewing machine according to claim 2, further comprising a striking needle plate which is detachably mounted on the sewing machine bed, wherein the striking needle is supported on the striking needle plate so as to be movable upward and downward.

5. The sewing machine according to claim 3, further comprising a first detection unit which detects the striking holder mounted on the sewing machine bed and a second detection unit which detects the striking needle plate mounted on the sewing machine bed, wherein the control device executes the engraving operation, subject to a condition that the first and second detection units have detected the striking holder and the striking needle plate respectively.

6. The sewing machine according to claim 4, further comprising a first detection unit which detects the striking holder mounted on the sewing machine bed and a second detection unit which detects the striking needle plate mounted on the sewing machine bed, wherein the control device executes the engraving operation, subject to a condition that the first and second detection units have detected the striking holder and the striking needle plate respectively.

7. The sewing machine according to claim 5, further comprising an informing unit which informs of an error when the second detection unit has not detected the striking needle plate even though the first detection unit has detected the striking holder or when the first detection unit has not detected the striking holder even though the second detection unit has detected the striking needle plate.

8. The sewing machine according to claim 6, further comprising an informing unit which informs of an error when the second detection unit has not detected the striking needle plate even though the first detection unit has detected the striking holder or when the first detection unit has not detected the striking holder even though the second detection unit has detected the striking needle plate.

9. The sewing machine according to claim 1, wherein the striking holder and the transfer mechanism have respective connections protruding in directions opposed to each other, and the striking holder is mounted via the connections on the transfer mechanism.

10. The sewing machine according to claim 1, wherein the striking holder has a recess having a bottom in an upper part thereof and holds the engraving workpiece.

11. The sewing machine according to claim 1, wherein either embroidery frame or striking holder is usable when the holder includes both embroidery frame and striking holder.

* * * * *